United States Patent [19]

Rees

[11] 4,383,063

[45] May 10, 1983

[54] POLYVINYL ALCOHOL BASED SIZE COMPOSITION

[75] Inventor: Richard W. Rees, Wilmington, Del.

[73] Assignee: E. I. Du Pont de Nemours and Company, Wilmington, Del.

[21] Appl. No.: 252,372

[22] Filed: Apr. 9, 1981

[51] Int. Cl.[3] ..... C08K 5/19

[52] U.S. Cl. ..... 524/91; 252/8.75; 524/93; 524/156; 524/236

[58] Field of Search ..... 525/3, 6; 260/29.6 B, 260/29.6 H; 252/8.8, 8.8 R, 8.8 AC, 8.8 AD; 524/91, 93, 156, 236

[56] References Cited

U.S. PATENT DOCUMENTS

| | | | |
|---|---|---|---|
| 3,087,920 | 4/1963 | Suzumura et al. | 260/29.6 B |
| 3,154,489 | 10/1964 | DuBrow et al. | 252/8.7 S |
| 3,268,470 | 8/1966 | Sheers et al. | 260/29.6 |
| 3,360,470 | 12/1967 | Wixon | 252/99 |
| 3,415,771 | 12/1968 | Woodruff | 260/33.4 |
| 3,686,025 | 8/1972 | Morton | 117/140 |
| 3,734,873 | 5/1973 | Anderson et al. | 260/29.6 B |
| 3,896,033 | 7/1975 | Grimm | 252/8.8 |
| 3,936,538 | 2/1976 | Marshall et al. | 427/242 |

FOREIGN PATENT DOCUMENTS 967714 8/1964 United Kingdom .

*Primary Examiner*—Stanford M. Levin

[57] ABSTRACT

Polyvinyl alcohol based sizing solution containing a small amount of quaternary (e.g., dialkyldimethyl) ammonium salt or quaternary imidazolinium salt additives provide good operability during application and weaving and results in fabric having improved finishing performance.

9 Claims, No Drawings

POLYVINYL ALCOHOL BASED SIZE COMPOSITION

BACKGROUND OF THE INVENTION

1. Field of the Invention

This invention relates to size compositions and more specifically it relates to polyvinyl alcohol based size compositions containing a quaternary salt additive.

2. Description of the Prior Art

Essentially all textile warp sizes for spun yarn at present contain a wax to provide operability during application, i.e., low drier drum sticking during slashing. However, these waxes are difficult to remove from the griege fabric prior to finishing. Special solvent extraction steps are sometimes taken, or the finishing mill must accept a high percentage of second quality or reprocessed fabric in certain styles. With current trends toward lower energy consumption, finishing mills are interested in lowering the temperature of their aqueous size removal systems, which causes further removal problems with wax.

The use of dimethyldistearyl ammonium chloride in textile softener compositions is known. For example, U.S. Pat. No. 3,154,489 discloses the use of quaternary ammonium salts, among them dimethyldistearyl ammonium chloride, in combination with an ethoxylated amine in the ratio of from 10:1 to 1:2. In one of the examples, among other additives, a small amount of polyvinyl alcohol was also included along with the softener.

U.S. Pat. No. 3,268,470 discloses that cationic polymeric sizing agents, which optionally may contain some vinyl alcohol units, are improved in dispersibility by the addition of quaternary ammonium chloride. The purpose is to render fibers resistant to penetration by aqueous solutions.

U.S. Pat. No. 3,360,470 discloses compositions comprising quaternary ammonium salt textile softener (such as dimethyldistearyl quaternary ammonium chloride) and alkali metal carboxymethyl cellulose. (anti-yellowing agent) It is contemplated that the above compositions be used in the form of additives to laundering compositions. The use of the softening agent in combination with known soil suspending agents was also disclosed. Among such soil suspending agents polyvinyl alcohol is shown in a softener to polyvinyl alcohol ratio of 4:2.

U.S. Pat. No. 3,686,025 discloses a fabric softening composition that contains dimethyldistearyl ammonium chloride. The softening composition is absorbed to a nonwoven cloth in which polyvinyl alcohol is used as the binder for the nonwoven cloth. The composition is used to produce textile softening in a standard automatic clothes dryer. The quaternary salt to PVA ratio is in excess of 100:1.

U.S. Pat. No. 3,896,033 discloses a textile softener, which can be dimethyldistearyl ammonium chloride, encapsulated in microspheres by an organic polymer, which can be polyvinyl alcohol. Normally the spheres are attached to a substrate. The ratio of quaternary salt to PVA is about 3.5:1.

U.S. Pat. No. 3,936,538 discloses fabric softener comprising a film-forming polymer, for example, polyvinyl alcohol, at least one softening agent, for example, dimethyldistearyl ammonium chloride, and at least one waxy surfactant. The ratio of quaternary salt to polyvinyl alcohol is at least 0.6:1.

U.S. Pat. No. 2,277,788 discloses water-repellent coating dispersion composition formed from polyvinyl alcohol, and oily or waxy substance (hydrocarbon), and cationic surface active agent, for example, dimethyldistearyl ammonium chloride. Aluminum salts can be added to further depress polyvinyl alcohol solubility. The ratio of quaternary salt to polyvinyl alcohol is about 0.2:1. The ratio of oily or waxy substance to polyvinyl alcohol is about 10:1.

U.S. Pat. No. 3,415,771 discloses a coating composition for treating image bearing transparencies to provide protection. The composition comprises a complex mixture of various size silica particles, a volatile solvent, an organic polymer, for example, polyvinyl alcohol, water, and formulations of cationic alkyl quaternary ammonium salts. The relative amounts of the silica particles, volatile solvent, polymer (e.g., PVA), water and quaternary ammonium salts are disclosed as follows:

| | |
|---|---|
| alcohol | 95% |
| quaternary | 0.1% |
| silica | 0.6% |
| polymer | 4% |

The ratio of quaternary salt to polyvinyl alcohol is about 0.025:1.

British Pat. No. 967,714 discloses a process for improving the wettability for dyeing of certain natural and synthetic materials by treating the fabric with an aqueous composition containing partially or completely esterified polyvinyl alcohol and aliphatic quaternary ammonium salt. The ratio of quaternary salt to esterified polyvinyl alcohol is about 1.1.

SUMMARY OF THE INVENTION

According to the present invention, there is provided a composition consisting essentially of (a) polymer selected from the group consisting of vinyl alcohol and vinyl alcohol/methylmethacrylate copolymer, and (b) salt additive selected from the group consisting of (α) quaternary imidazolinium salt having the formula

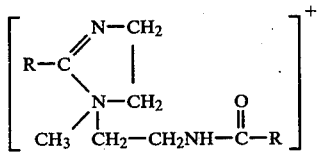

or

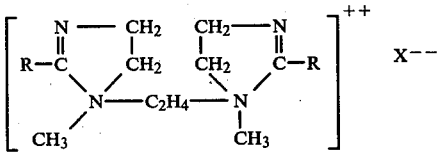

where X is an anion and R is an alkyl group containing 12 to 18 carbon atoms and (β) quaternary ammonium salt having the formula

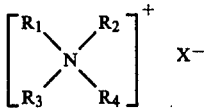

where $R_1$ is an alkyl group containing 1 to 3 carbon atoms, $R_2$ is an alkyl group containing 1 to 3 or 12 to 22 carbon atoms, $R_3$ and $R_4$ are alkyl groups containing 12 to 22 carbon atoms, and X is an anion wherein the weight ratio of salt additive to vinyl alcohol polymer is from about 0.001 to about 0.02.

As used herein, the terms "consisting essentially of" means that the named ingredients are essential; however, other ingredients which do not prevent the advantages of the present invention from being realized can also be included.

DETAILED DESCRIPTION OF THE INVENTION

It has been discovered that the addition of dimethyldialkyl ammonium salt to polyvinyl alcohol based size, in the amount of 2% or less quaternary salt based on the weight of the polyvinyl alcohol, will provide quick release from drier drums during slashing, and excellent size removal by aqueous systems thus resulting in exceptional dyeability. Furthermore, the aqueous removal can be accomplished at lower temperatures than in current practice for fabrics that are not heat set. The new size formulation of the present invention can be readily employed in the conventional sizing, heat setting and aqueous removal operations presently used by spun yarn textile mills.

For the purposes of the size composition of the present invention the vinyl alcohol polymer can be (a) a fully hydrolyzed PVA such as produced by methanolysis of polyvinyl acetate homopolymers or vinyl acetate/methylmethacrylate copolymers having a viscosity range of from about 5 to about 40 mPa·s (cps) at 20° C. (4% solution); or (b) a partially hydrolyzed PVA containing from about 4 to about 12 mole % vinyl acetate having the same viscosity range.

The salt additive employed in the size composition of the present invention is selected from the group consisting of (α) quaternary imidazolinium salt having the formula

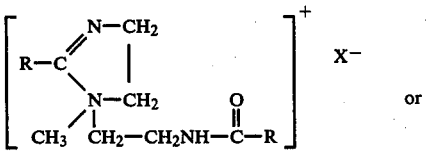

or

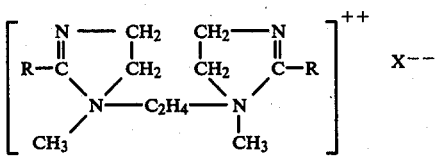

where X is an anion and R is an alkyl group containing 12 to 18 carbon atoms and (β) quaternary ammonium salt having the formula

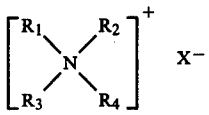

where $R_1$ is an alkyl group containing 1 to 3, but preferably 1, carbon atoms, $R_2$ is an alkyl group containing 1 to 3 or 12 to 22 but preferably 1, or 12 to 22 carbon atoms, $R_3$ and $R_4$ are alkyl groups containing 12 to 22 carbon atoms, and X is an anion, e.g., methylsulfate, chloride, preferably chloride.

The ratio of salt additive to vinyl alcohol polymer is from about 0.001 to about 0.02 (i.e., 0.1 to 2% salt additive based on the weight of PVA).

At least about 0.1% additive is necessary to obtain significant drier drum release, while greater than 2% additive could give poor weavability. The preferred composition contains from about 0.2 to about 0.5% additive based on the weight of the PVA.

Starch is often used blended with PVA in sizing compositions. Similarly, the present size composition can contain common textile warp size starch. The sizing composition of the present invention can also be modified with other materials for specific textile uses as is customary in sizing applications.

The aqueous size solution of the present invention will generally have a solids content of from about 2 to about 20 percent by weight. Preferably the solids content is from about 7 to about 18 percent by weight.

The use of the polyvinyl alcohol/salt additive composition of the present invention for sizing spun yarn from aqueous solution results in good operability during application and weaving and results in fabric which has improved finishing performance. Especially, such compositions show enhanced ability to absorb dye rapidly and uniformly after aqueous removal of size.

The following examples are given for the purpose of illustrating the present invention. All parts and percentages are by weight unless otherwise specified.

EXAMPLES 1 AND 2 AND COMPARATIVE EXAMPLE 1

Sizing solutions were prepared in a steam jacketed kettle by adding the polyvinyl alcohol to the requisite amount of cold water to form a 10 percent solution; then the temperature was brought to 77° C. with stirring. Five percent hydrogenated tallow based on the polyvinyl alcohol was added with stirring to the size solution. This solution was used to size 26 singles 65 polyester/35 cotton spun yarn using a Calloway Model 51 Slasher operating at 10 meters per minute. After sizing the size add-on was measured by weight loss after extraction with boiling water. The sized yarn was tested using a laboratory abrasion tester. The abrasion test consists of stringing sized threads through a section of a conventional weaving loom reed and applying controlled tension. The reed is made to oscillate against the threads which are set at an angle of about 15° with respect to the motion of the reed. Thus an abrasion is established. Either the amount of visual abrasion of the yarn after a specific number of abrasion cycles, or the average number of cycles to cause yarn failure is measured.

In subsequent tests 0.5 and 1.0% "Arosurf" TA-100 was used instead of the hydrogenated tallow. Samples of the sized yarn were heat-treated by passage through an oven at 200° C. (hold-up time 30 sec). The percent removal of size was determined by a laboratory method involving removal of size by multiple dipping in 60° C. water for 45 seconds and then wringing. The samples are thoroughly dried and weighed before and after the removal procedure. The amount of size removed compared to the amount of size on the original sized yarn is measured.

The polyvinyl alcohol (PVA) employed in these Examples has a 4 percent solution viscosity of 14 mPa·s, 98+ percent hydrolysis and was made according to the process of U.S. Pat. No. 3,689,469.

Compositions and properties are summarized in Table I.

TABLE I

| Example | Composition | Size Add-on % | Room Temp. Brookfield Viscosity mPa · s | Abrasion after 1000 cycles | Removal in 60° C. Water % |
|---|---|---|---|---|---|
| C-1 | PVA + 5% hydrogenated tallow | 14.3 | 292 | medium shedding | 77 |
| 1 | PVA + 0.5% "Arosurf" TA-100(1) | 14.3 | 300 | only light shedding | 77 |
| 2 | PVA + 1.0% "Arosurf" TA-100 | 14.8 | 300 | heavy shedding some broken yarn | 75 |

(1)distearyldimethyl ammonium chloride available from Sherex Chemical Company, Inc., Dublin, Ohio This example serves to show the utility of 0.5% distearyldimethyl ammonium chloride in slashing compared with a conventional wax. Abrasion resistance, aqueous removal and viscosity are quite similar.

EXAMPLE 3

A sizing solution was made up by slurrying 45 kg. of the PVA of Examples 1–2, and 0.22 kg. of "Arosurf" TA-100 in 564 kg of water. A solution was formed by sparging with live steam, while stirring until a temperature in excess of 190° F. (88° C.) was achieved. Additional water was added to bring the final solution to 7.0% solids. This material was used to size a polyester/-cotton spun yarn with a conventional commercial slasher. Slashing qualities were adequate, especially drum release. Weaving was accomplished with the slashed yarn. After aqueous removal of the size during finishing, without use of special solvents, dyeing quality was excellent.

As a comparison, a size solution containing 10 lbs. of conventional tallow wax instead of the "Arosurf" TA-100, gave much lower dyeing quality in spite of the use of a special solvent in addition to the aqueous removal system.

EXAMPLES 4 TO 6 AND COMPARATIVE EXAMPLES 2 TO 4

Size preparation and testing procedures were as in Example 1, but containing various levels of "Arosurf" TA-100. Final solution had about 10% solids.

A quantitative measure of #1 drier drum deposit during slashing was made by using a drum temperature of 90° C., thoroughly cleaning the drum and then using a squeegee to remove the drum deposit after two minutes of continuous running. The time for a solution of Chemurgy green dye to penetrate one inch up a hank of dry yarn after desizing in 70° C. water was used to illustrate dye absorption.

Compositions and properties are summarized in Table II.

TABLE II

| Example | Composition | Estimated Drum Deposit mg. | Dye Penetration, Sec. |
|---|---|---|---|
| C-2 | PVA | 95 | 6 |
| 4 | PVA + 0.3% "Arosurf" TA-100 | 44 | 6 |
| 5 | PVA + 1.0% "Arosurf" TA-100 | 37 | 6 |
| 6 | PVA + 1.4% "Arosurf" TA-100 | 35 | 6 |
| C-3 | PVA + 3.9% hydrogenated tallow wax | 15 | 13 |
| C-4 | PVA + 10% hydrogenated tallow wax | 10 | >50 |

A release additive for slashing is necessary to prevent excessive dryer drum deposits from forming. Deposits tend to develop at an equilibrium level within a minute of operation. If excessive, they can be picked off and decrease the quality of the yarn for weaving and finishing. The data above show that "Arosurf" TA-100 at about 0.5% or more based on PVA, greatly decreases drum deposit, while not interfering with the basic dye absorption of the yarn. Wax also decreases drum deposit levels, but it interferes with dye absorption.

EXAMPLES 7 TO 14 AND COMPARATIVE EXAMPLE 5

The same size preparation and testing procedures were used as in Examples 4 to 6 except the solids level was 7 percent. Compositions and properties are summarized in Table III.

TABLE III

| Example | Composition | Estimated Drum Deposit mg | Dye Penetration sec. |
|---|---|---|---|
| C-5 | PVA | 95 | 6 |
| 7 | PVA + 1.6% "Arquad" 20–75(1) | 35 | 7 |
| 8 | PVA + 3.4% "Arquad" 20–75 | 35 | 7 |
| 9 | PVA + 1.2% "Arquad" 2HT(2) | 50 | 7 |
| 10 | PVA + 0.6% "Kemamine" 1902C(3) | 39 | 7 |
| 11 | PVA + 1.0% "Kemamine" | 36 | 7 |
| 12 | PVA + 0.4% "Varisoft" 190(4) | 47 | 6 |
| 13 | PVA + 1.2% "Varisoft" 190 | 33 | 7 |
| 14 | PVA + 1.1% "Varisoft" | 50 | 10 |

TABLE III-continued

| Example | Composition | Estimated Drum Deposit mg | Dye Penetration sec. |
|---|---|---|---|
| | 445[5] | | |

[1]dicocodimethyl ammonium chloride, available from Armak Industrial Chemical Division, Akzona, Inc., Chicago, Illinois.

[2]dihydrogenated tallow dimethyl ammonium chloride, available from Armak Industrial Chemical Division, Akzona, Inc., Chicago, Illinois.

[3]dimethyl 90% diarchidyl/behenyl ammonium chloride available from Humko Sheffield Chemical Division, Kraft, Inc., Memphis, Tennessee.

[4]dimethyldistearyl ammonium methyl sulfate, available from Sherex Chemical Company, Inc., Dublin, Ohio.

[5]methyl-1 hydrogenated tallow amido ethyl-2-hydrogenated tallow imidazolinium-methylsulfate, available from Sherex Chemical Company, Inc., Dublin, Ohio.

These data show some other long chain dialkyldimethyl quaternaries (chloride or sulfate) that are effective in reducing drum deposits.

I claim:

1. A composition consisting essentially of (a) vinyl alcohol polymer selected from the group consisting of polyvinyl alcohol and vinyl alcohol/methylmethacrylate copolymer, and (salt additive selected from the group consisting of (α) quaternary imidazolinium salt having the formula

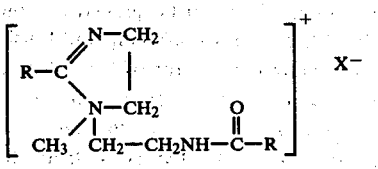

or

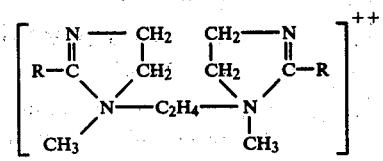

where X is anion and R is an alkyl group containing 12 to 18 carbon atoms, and (β) quaternary ammonium salt having the formula

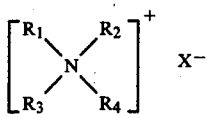

where $R_1$ is an alkyl group containing 1 to 3 carbon atoms $R_2$ is an alkyl group containing 1 to 3 or 12 to 22 carbon atoms $R_3$ and $R_4$ are alkyl groups containing 12 to 22 carbon atoms, and X is an anion wherein the weight ratio of salt additive to vinyl alcohol polymer is from about 0.001 to about 0.02.

2. The composition of claim 1 wherein the anion X in the quaternary imidazolinium and ammonium salt is selected from the group consisting of chloride, and methylsulfate.

3. The composition of claim 2 wherein the vinyl alcohol polymer is selected from the group consisting of fully hydrolyzed polyvinyl alcohol, fully hydrolyzed vinyl alcohol/methylmethacrylate copolymer which contains from about 2 to about 6 percent by weight of copolymerized methylmethacrylate comonomer, and partially hydrolyzed polyvinyl alcohol containing from about 4 to about 12 mole % vinyl acetate, said fully and partially hydrolyzed polyvinyl alcohol polymers having a 4 percent solution viscosity of from about 5 to about 40 mPa·s at 20° C.

4. The composition of claim 3 wherein the polymer is fully hydrolyzed vinyl alcohol/methylmethacrylate copolymer containing from about 2 to about 6 percent by weight of copolymerized methylmethacrylate comonomer.

5. The composition of claim 4 wherein the salt additive is quaternary ammonium salt, $R_1$ is an alkyl group containing 1 carbon atom, $R_2$ is an alkyl group containing 1 or 12 to 22 carbon atoms, $R_3$ and $R_4$ are alkyl groups containing from 12 to 22 carbon atoms and anion X is chloride or methylsulfate.

6. The composition of claim 5 wherein the salt additive is dimethyl distearyl ammonium chloride.

7. The composition of claim 6 wherein the ratio of salt additive to polyvinyl alcohol is from about 0.002 to about 0.005.

8. The composition of claim 1, 3, 5, 7 or 4 in the form of an aqueous solution having a solids content of from about 2 to about 20 percent by weight.

9. The composition of claim 1, 3, 5, 7 or 4 in the form of an aqueous solution having a solids content of from about 7 to about 18 percent by weight.

* * * * *